US006807783B2

(12) United States Patent
Lee

(10) Patent No.: US 6,807,783 B2
(45) Date of Patent: Oct. 26, 2004

(54) WINDOW FRAME MOLDING SYSTEM

(76) Inventor: Han-Sen Lee, 98-1, Show-Tsuo St. Show-Tsuo Village, Fu-Hsing Hsiang, Chang-Hwa Hsien (TW)

( * ) Notice: Subject to any disclaimer, the term of this patent is extended or adjusted under 35 U.S.C. 154(b) by 0 days.

(21) Appl. No.: 10/330,948

(22) Filed: Dec. 27, 2002

(65) Prior Publication Data

US 2004/0123536 A1 Jul. 1, 2004

(51) Int. Cl.[7] ..... E06B 7/08

(52) U.S. Cl. ..... 52/473; 52/656.2; 52/656.4; 52/211

(58) Field of Search ..... 52/212, 208, 204.54, 52/656.2, 656.5, 656.9, 473, 211

(56) References Cited

U.S. PATENT DOCUMENTS 4,628,648 A * 12/1986 Winyard ..... 52/204.54
4,982,530 A * 1/1991 Palmer ..... 49/504
6,047,514 A * 4/2000 Verch ..... 52/656.5
6,050,037 A * 4/2000 Gifford ..... 52/211
6,148,584 A * 11/2000 Wilson ..... 52/717.01
6,173,542 B1 * 1/2001 Wright ..... 52/211
6,609,349 B2 * 8/2003 Davidsaver ..... 52/771
6,643,988 B1 * 11/2003 Armstrong et al. ..... 52/656.2

* cited by examiner

*Primary Examiner*—Peter M. Cuomo
*Assistant Examiner*—Stephanie Harris
(74) *Attorney, Agent, or Firm*—Curtis L. Harrington

(57) ABSTRACT

A window frame molding system with removeable and interchangeable moldings of the present invention provide an organizational system which can be used to install, change, and remove window frame moldings while not damaging the window frame itself. For a rectangular installation, the entire structure can consist of four straight pieces of metal, plastic, synthetics, or wood, as mounting members, with the ends either flat or cut angularly at 45°, as the base of the structure. Further, four decorative moldings and four junction pieces of metal, plastic, synthetics, or wood, interfit with the mounting member in a configuration with the moldings being slide locked into place and the junction pieces securing the decorative moldings in place. Because of the variety of materials which can be used to make the window frame moldings, they are both inexpensive and easy to manufacture.

11 Claims, 4 Drawing Sheets

WINDOW FRAME MOLDING SYSTEM

FIELD OF THE INVENTION

The present invention relates to a convenience structure for mounting and applying window frame moldings, and more specifically to provide users with a window molding system for framing a window covering which helps the user save time, it provides variety, and a more organized window molding system.

BACKGROUND OF THE INVENTION

Prior art structures for window frame moldings have been most rudimentary and disorganized, mostly consisting of a regular molding being nailed or glued around the perimeter of a window by an installer. Frame moldings utilized with window coverings are not purely for aesthetic purposes but are typically mounted about the periphery of a window opening and oriented to extend within the dimensions of the window opening to form a smaller opening to cover the light space between the outer edges of the window covering (typically horizontal blinds) and the window opening within which the window covering operates.

The provision of a window opening peripheral additional cover enables a typical horizontal blind window covering to operate much more efficiently in shutting out light in the closed position. Unwanted light which is eliminated includes light entering at the top of the channel support, sides of the channel supports, ends of the louvers and the ends and bottom of the base louver. Where the base louver either falls short of the bottom of the window opening or where the base louver is pivotally mounted by a hold down, significant light can enter at the base of the bottom louver. The window opening peripheral additional cover significantly contributes to light blockage at the bottom of the window covering.

Aside from both functionality and aesthetics the question of replacement is an important one. Replacement can be required due to damage or due to the desire for aesthetic change. Where conventional window opening peripheral additional cover is custom made and fitted into an opening replacement is not only expensive and burdensome, but can cause significant damage to the surrounding wall areas. As a result, replacement of conventionally installed window opening peripheral additional cover members will include a second custom installation as well as surrounding wall repair.

When the user desires to change or remove the molding because of color, style or damage to the molding, the wall segment around the window's perimeter will have nail holes, chipped wall board around the nail holes, and the existing nail holes cannot be re-used because of enlargement or damage to the material. Plus the removed molding will be ruined and most un-usable.

When removing window moldings which were installed using glue or glue like substances, wall areas may be left with glue residue and debris, meaning that the installer will now have to put extra effort into plastering, cleaning, and stripping the area before new window moldings can be used.

Most window moldings today are usually made out of wood, a material which is not very durable and cannot fully withstand many climate variations, temperatures, and everyday exposure to the elements. When typical window moldings remain in a normal setting such as a house, the window moldings can be easily ruined by everyday occurrences such as water damage, thermal cracking, wood rot, bowing and fracturing, children's abuse of the molding, chipped paint, and termites.

For a premises owner, or user, to replace the damaged window moldings with new ones, the user would have to destructively remove the damaged moldings (as described above), buy new moldings, have an installer install them or begin measuring and cutting them for a custom installation. This can be very costly and time consuming for the user.

Another impracticality of window moldings is, especially since moldings are usually made out of wood, that they are less durable and the cost of manufacture is much greater than manufacturing and molding plastic, metal, synthetic, and fiberglass materials.

Most window moldings are meant to be permanent fixtures around the window. This has a disadvantage in that the user can't easily change the color or style. If a user wishes to change the room colors by painting the room, and wants to match the moldings to the new paint, the moldings will look messy and unprofessional after being painted, especially if they cannot be removed to paint them throughly.

The ability to, in a organized and easy manner, change or remove window moldings is an advantage which is conventionally not available, or available at a reasonable cost.

What is therefore needed is a device or structure which can easily and affordably allow window moldings to be changed or removed in an organized manner. The device needs to be easy to use so it will be more convenient to use it. It needs to be easy to install and not messy so when the window molding is removed, users will not have to do a lot of preparation to install a different molding. The device needs to be simple and inexpensive, so the majority of the general public can afford it. The device needs to help in reducing the time and effort spent in removing, changing, and installing window moldings.

SUMMARY OF THE INVENTION

A window frame molding system with removeable and interchangeable moldings of the present invention provide an organizational system which can be used to install, change, and remove window frame moldings while not damaging the window frame itself.

The entire structure consists of mounting support members and finish members. The mounting members are typically four straight pieces of metal, plastic, synthetics, or wood, with the ends cut angularly at 45°, and which forms the mounting base of the structure. The finish members include typically eight pieces of metal, plastic, synthetics, or wood, four straight members and four corner members, to interfit as exterior molding members. Because of the variety of materials which can be used to make the window frame moldings, they are very inexpensive and easy to manufacture.

The window frame molding system is of simple construction and user-friendly. The system of mounting the molding pieces by placing the pieces on pegs and slide locking them into place with screws, is nearly foolproof, thus, users will not have a hard time using the window frame molding system. Plus, the way that the moldings slide-lock in to place is much easier than the usual conventional method of gluing or nailing the moldings into place around the window frame. Also, the slide lock method is not messy like the two conventional methods mentioned above.

Since the window frame molding system can be made out of many different types of material, such as, metal, synthetics, plastics, and wood, the window frame molding system should be rather inexpensive to manufacture. Also, all the materials which can be used in making the window frame molding system can be treated with sealants and preservers so they will not be damaged by rust, wood rot, or termites. Plus, since the window frame molding system is so inexpensive to produce, they can be manufactured in many different styles and patterns so the users will have more of a variety of window moldings to use, and will be able to change moldings when they change the molding surroundings such as, painting the room the window frame molding system is being used in.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENTS

Figure 1:
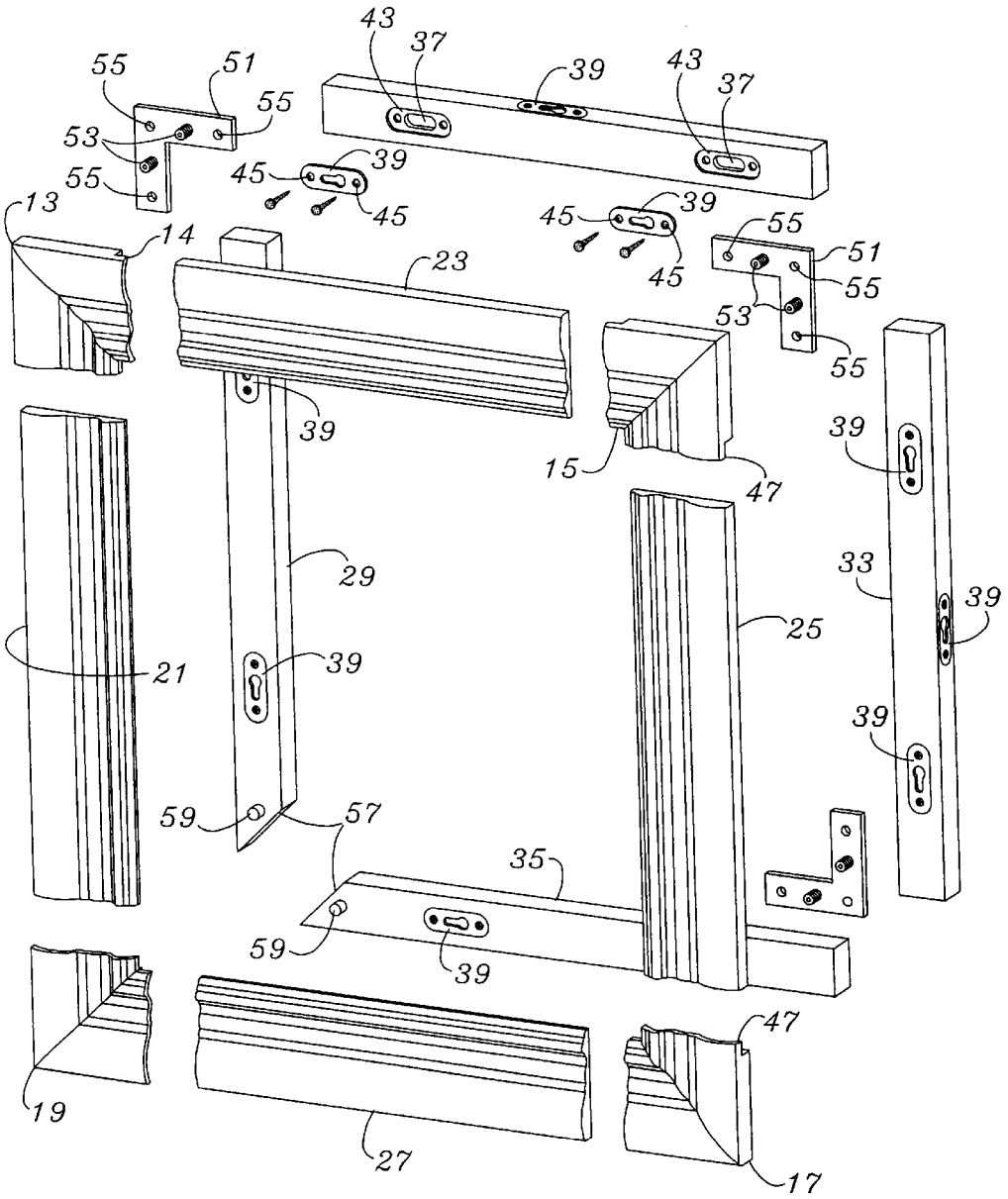
FIG. 1 is an exploded perspective of a window frame molding system illustrating the components and their method of assembly.

A description of the inventive window frame molding system as shown in FIG. 1 as a window frame molding system 11. FIG. 1 is an exploded overall view of the components of the system 11, including mounting support members and finish members. The entire system 11 shown in FIG. 1 consists of sixteen major pieces in combination with keyhole reinforcements. The system shown contemplates a rectangular realization, however other geometrical shapes are possible with a corresponding increase in the number of parts.

The system 11 includes finish members including four junction pieces 13, 15, 17, and 19, four pieces of decorative molding 21, 23, 25, and 27. Junction pieces 13, 15, 17, and 19 are shown as corner pieces where the window covering opening is rectangular. The junction pieces 13, 15, 17, and 19, occur at the corners, but there is no reason that they should not occur also along straight lengths of the decorative molding 21, 23, 25, and 27.

Further, there is no reason that the slide lock mechanism disclosed would not work at various places along the molding 21, 23, 25, and 27. In other words, the rectangular window opening shape may have its molding 21, 23, 25, and 27 periodically interrupted with junction pieces 13, 15, 17, and 19 not located at angled meetings of the molding 21, 23, 25, and 27 but between straight sections. Further, for shapes other than rectangular, such as pentagonal, hexagonal and the like, the molding 21, 23, 25, and 27 may be provided and over window openings of these shapes, especially where either the wall is built out to provide adequate operating space for a rectangular blind set or where the fully opened blind set matches the shape.

Behind the finish members 13, 15, 17, 19, 21, 23, 25, and 27 are four pieces of straight mounting members 29, 31, 33, and 35. The straight mounting members 29, 31, 33, and 35 are generally rectangular cross section, elongate stick shapes, but may end in forty-five degree angle tapers in order to form a sharp corner. The custom interfit of the ends of the straight mounting members 29, 31, 33, and 35 would be done where it was desired to keep out the last measure of light.

The straight mounting members 29, 31, 33, and 35 are preferably pre bored with a series of keyhole or slot depressions 37. The slot depressions 37 are preferably covered by a keyhole plate 39. The use of the keyhole plate relieves the need to seek materials which could provide a naturally formed keyhole opening, as well as the need to form a partially enclosed volume within a solid piece of material.

The slot depressions 37 are provided to enable good clearance for a bolt or screw head to enter through the keyhole plate 39 without interference from the material of the straight mounting members 29, 31, 33, and 35. Slot depressions 37 typically include a deep slot portion 41 and a keyhole plate 39 countersunk portion 43 to enable the keyhole plate 39 to fit at or beneath the external surface level of the straight mounting members 29, 31, 33, and 35.

The keyhole plate 39 typically has a pair of end apertures 45 for mounting with threaded apertures (not shown) into the material of the straight mounting members 29, 31, 33, and 35. Again, the area around the apertures 45 are appropriately lowered or countersunk so that the heads of the threaded members also lie below the outer surfaces of the straight mounting members 29, 31, 33, and 35.

Also note that the four junction pieces 13, 15, 17, and 19 each have an overlapping lip 47 which continues a shape which generally conforms to the shape of the decorative molding 21, 23, 25, and 27. The overlap enables the pattern to be semi-continuous although the lip can be seen to overlap a portion of the pattern at the end of the decorative molding 21, 23, 25, and 27. This has the advantage that a relatively rough cut end of the decorative molding 21, 23, 25, and 27 is well covered by the lip 47 and will not show. The disadvantage is that the discontinuity is more apparent than it would otherwise be in a custom frame.

In terms of overall utility, the slot depressions 37 and their associated keyhole plates 39 will be located at an even spacing along the length of one or more of the side surfaces of the straight mounting members 29, 31, 33, and 35. As can be seen, the straight mounting members 29, 31, 33, and 35 have a somewhat rectangular cross section. The mounting methodology for the straight mounting members 29, 31, 33, and 35 can include mounting about the outside periphery of a window opening or mounting about the inside periphery of a window opening. The method of attachment of the straight mounting members 29, 31, 33, and 35 is preferably by any means and includes gluing, nailing, and the like. Regardless, the best stability is had by mounting one of the relatively wider sides against the wall surface to which they are to be attached. For mounting on the outside of the window opening, the four pieces of decorative molding 21, 23, 25, and 27 will fit into slot depressions 37 and their associated keyhole plates 39 on the opposite, relatively wider surface of the straight mounting members 29, 31, 33, and 35, as is seen in FIG. 1.

However for mounting on the inside, inner periphery of a window opening, the four pieces of decorative molding 21, 23, 25, and 27 will fit into slot depressions 37 and their associated keyhole plates 39 on the adjacent, relatively wider surface of the straight mounting members 29, 31, 33, and 35.

As a result, the four pieces of decorative molding 21, 23, 25, and 27 preferably come with the slot depressions 37 and their associated keyhole plates 39 pre-formed on two adjacent sides, as is seen in FIG. 1. Further, the spacing of the slot depressions 37 and their associated keyhole plates 39 is an even spacing, and no regard need be given (although it can be in some exacting cases) to the exact positioning of the slot depressions 37 and their associated keyhole plates 39 along the straight mounting members 29, 31, 33, and 35.

In the case of a rectangular window opening as is the case in FIG. 1, once the four pieces of straight mounting members 29, 31, 33, and 35 are cut and positioned with regard to a window opening, the four pieces of decorative molding 21, 23, 25, and 27 can be fitted (as will be shown) with the excess then cut off to yield a system which is specific to the installed straight mounting members 29, 31, 33, and 35.

Also seen in FIG. 1 are a series of brackets 51 which are shown at the corners or angles of the system 11, although not required to be placed at the corners or angles. Brackets 51 are typically found at the angular meeting points of the mounting pieces 29, 31, 33, 35, although brackets 51 could be placed along the main length of mounting pieces 29, 31, 33, 35 to hold many such junction pieces 13, 15, 17, and 19 where punctuation of the molding 21, 23, 25, and 27 with junction pieces 13, 15, 17, and 19 is desired.

Brackets 51 are preferably made of thin metal with a pair of polymeric projections 53 and a series of attachment apertures 55. The polymeric projections 53 engage and hold junction pieces 13, 15, 17, and 19 by means of a generally matched rear bore in the back sides of the junction pieces 13, 15, 17, and 19. The polymeric projections 53 may preferably be made of deformable material in order to have a better hold. A circular shape with ribs to concentrate the deformation is shown in FIG. 1. The downward angled ribs give a preferred deformation upon insertion and more force upon removal to insure a good lock.

The brackets 51 perform two important functions. By being attached with apertures 55 to the straight mounting members 29, 31, 33, and 35, they are thus strengthened by mutual force support. In other words, once the brackets 51 are added, the straight mounting members 29, 31, 33, and 35 have the strength of a mounted stiff frame rather than the individual strengths of the members.

Secondly, the brackets 51 have a width approximately equal to the narrowest width of the straight mounting members 29, 31, 33, and 35 and are thus easily located and positioned at the exact corners. It is not necessary for two straight mounting members 29, 31, 33, and 35 to abut or meet exactly at a corner. An overlap of one member over the other is acceptable. A gap is also acceptable. The brackets 51 have sufficient strength to lend the proper stability to the resulting frame.

The lengths of decorative molding 21, 23, 25, and 27 may have a series of pre-inserted threaded members having heads for engaging the deep slot portion 41 and a keyhole plate 39. The series of pre-inserted threaded members (not shown in FIG. 1) should have the same spacing as the series of pre-inserted threaded members. When this is the case, and once the mounting members 29, 31, 33, and 35 are in place, the lengths of decorative molding 21, 23, 25, and 27 may be fitted in place and have the excess end material removed. Some test interfitting may be required so that a particular one of the lengths of decorative molding 21, 23, 25, and 27 can be matched with a single one of the mounting members 29, 31, 33, and 35 which will give the most advantageous elimination of scrap or even of cutting.

Savings in cutting may occur where identified non cut ends of the lengths of decorative molding 21, 23, 25, and 27 are coordinated with an identified end of one of the mounting members 29, 31, 33, and 35 with cutting indicated to occur on the other end of the mounting members 29, 31, 33, and 35, such that cutting of the molding 21, 23, 25, and 27 can be made to occur on one end only. This technique can reduce cutting to one cut per piece, both for the mounting members 29, 31, 33, and 35, as well as the molding 21, 23, 25, and 27.

An optional corner cut 57 with implaced pegs 59 illustrates a variation where corners may be moved precisely together and where pegs 59 may be utilized. In this case it is better to pre manufacture the corner cut 57 and pegs 59 to indicated them as being the ends of the mounting members 29, 31, 33, and 35 which are restrained from cutting. If such a mixed system is utilized, the two opposite corners should be corner cut 57 with pre-inserted pegs 59 and possibly marked to indicate that no cutting should occur. This would leave only two brackets 51 to be installed. In the alternative, all four corners may have brackets 51 and the ends of the mounting members 29, 31, 33, and 35 could still be marked for non cutting and for fitting abutment into the window opening.

Figure 2:
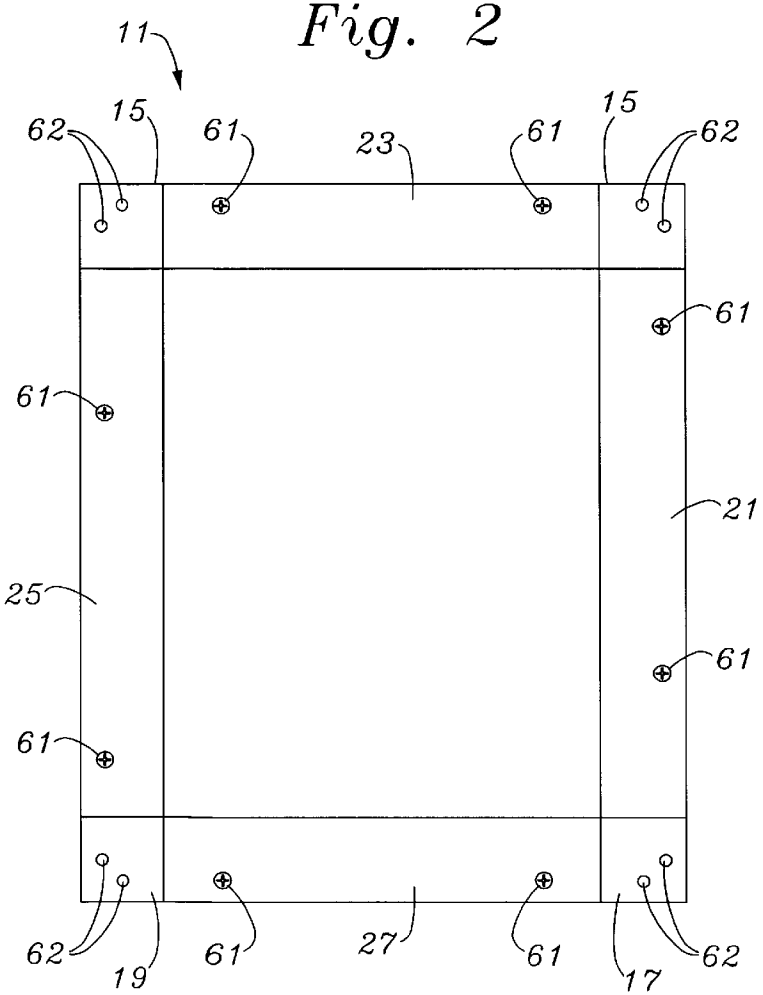
FIG. 2 is a back view of the window frame molding showing the screws used to slide lock the molding into place, and the two peg blind bores in each corner.

The system 11 in FIG. 2 shows a rear view of the constructed moldings and including a first view of a series of a series of evenly spaced slide-lock screws 61. Note that the slide-lock screws 61 begin at a given spacing from one end of each of the molding lengths 21, 23, 25, & 27, and appear not to be symmetrical along their lengths. The slide-lock screws 61 are preferably machine inserted at the factory to insure that they will correspond to the placement of the keyhole plates 39. Since boring and chamfering accompanied the placement of the keyhole plates 39, any mis-alignment could be quickly remedied by re-positioning of the slide-lock screws 61. Further, the insertion of the slide-lock screws 61 should be of an exact depth to enable operation with the keyhole plates 39 without further adjustment, although such further adjustment could be easily had with a few degrees of turn with a screwdriver.

Also seen are a pair of blind bores 62 which are arranged in somewhat of a forty five degree orientation as a line between them. The positioning of the blind bores 62 corresponds with the positioning of the polymeric projections 53. In the case of the corner cut 57 ends, the pre-inserted pegs 59 are pre-positioned to interfit with the blind bores 62. In either case, the blind bore 62 positioning causes a positive lock to be transmitted back from the mounting pieces 29, 31, 33, 35.

Figure 3:
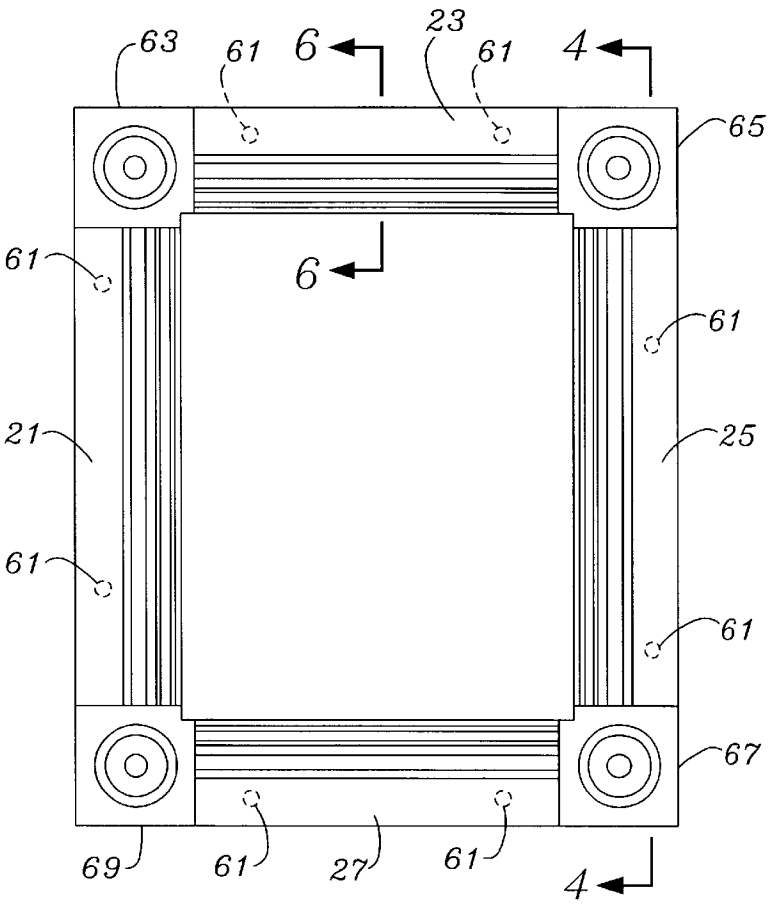
FIG. 3 is a front view of the assembled window covering frame system but with non-closely conforming junction pieces, corner pieces in the case of a rectangular configuration, which extend slightly into the area within the frame opening.

Referring to FIG. 3, a variation on the junction pieces 13, 15, 17, and 19 are seen as junction pieces 63, 65, 67, and 69 where these junction pieces have a lip having an underside surface which does not conform to the overall pattern of the molding 21, 23, 25, and 27. However since the upper surface of the lip is a generally flat pattern dominated by the surface pattern of the junction pieces 63, 65, 67, and 69 there is sufficient material to enable a clearance to the rear to overlap the molding pattern.

In FIG. 3 the overall motif is such that the corner patterns project such that it is clear that the frame is not one piece, but the overlap appears more deliberate and the corners dominate the pattern. The view of FIG. 3 emphasizes that the patterns can be mixed and matched to produce more dramatic effect.

Figure 4:
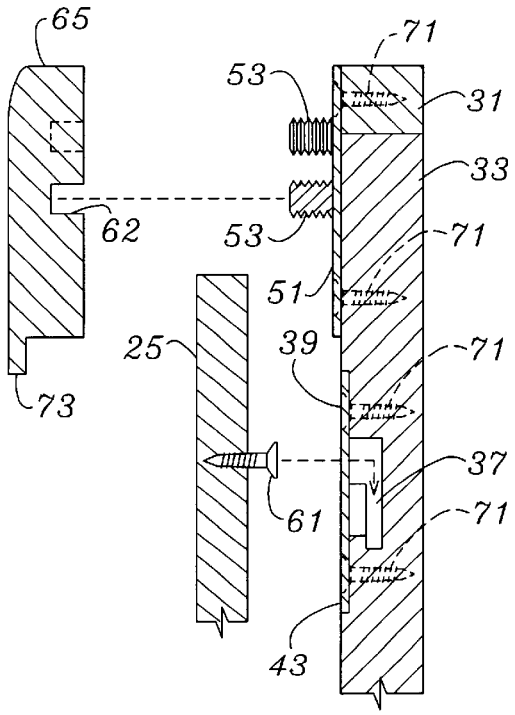
FIG. 4 is a side sectional view taken along line 4—4 of FIG. 3 and illustrates the top portion of an unassembled view of a straight molding pieces about to enter a locked position with a mounting piece and locked into place with a junction piece.

Referring to FIG. 4, side sectional view taken along only the upper portion of section line 4—4 shows the cross section of the interfit. The top straight mounting piece 31 is shown as coming completely through and atop the side straight mounting piece 33, to illustrate one possible manner of fit. To the left of mounting pieces 33 and 31 is seen the bracket 51 and its leftwardly extending polymeric projections 53. A pair of threaded members 71 are shown securing the bracket 51 into the mounting pieces 31 and 33.

To the left, decorative molding 25 is seen as having a slide screw 61 protruding a sufficient amount to enter through the large end of the keyhole plate 39 resting in the countersunk portion 43 such that the head of the slide screw 61 enters the slot depression 37. The dashed arrow gives the direction of entrance and translation of the head of the slid screw 61 as it moves toward the terminal end of the slot depression 37 and into a locked position.

In terms of locking, friction locking or narrowed locking is not necessary as the implacement of the junction piece 65 will prevent the slide screw 61 from reversing its path within the slot depression 37. Thus, so long as the junction piece 65 is located at the end of a molding 25 which moved away from that corner in order to lock into place, it cannot reverse its path to become unlocked. Also seen in FIG. 5 is a lip 73 on the junction piece 65.

Figure 5:
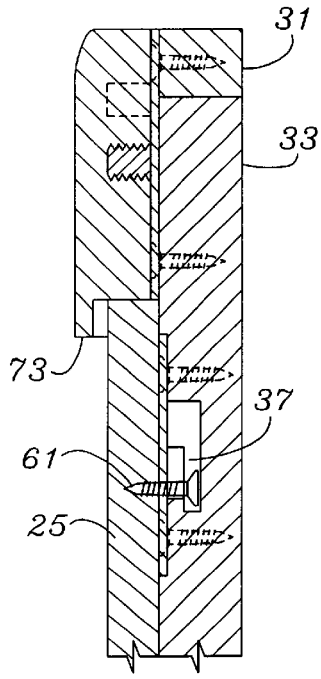
FIG. 5 is a side sectional view in accord with FIG. 4 after locking and securing of the junction piece has taken place.

This is illustrated in FIG. 5 with a view of both the top and bottom portions. The molding 25 has to be moved up in order to free it from the mounting piece 33.

Figure 6:
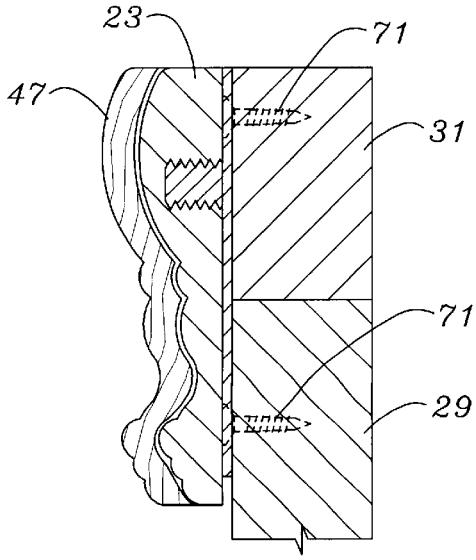
FIG. 6 is a side sectional view taken along line 6—6 of FIG. 1 and illustrating the close conformity between the exterior pattern of a straight molding and the underside and top side of a lip of a junction piece.

Referring to FIG. 6, an assembled view taken along line 6—6 of FIG. 1 illustrates how the lip 47 overlies the top surface of the molding 23. It also shows how the lip 47 has an underside and a top side which generally conforms to the details of the outer surface of the pattern on the molding 23.

The polymeric projections 53 preferably has a series of side engagement ridges which have a good hold on the junction piece 65. A first set of decorative moldings 21, 23, 25, and 27 can be removed by simply removing the junction pieces 63, 65, 67 and 69, moving the decorative molding 21, 23, 25, and 27 to unlock position and putting them away. A second set of decorative molding 21, 23, 25, and 27 can be purchased, fitted, marked, and cut to fit in the same manner as the first set of decorative molding 21, 23, 25, and 27. Optionally, a second set of junction pieces 13, 15, 17, and 19 or junction pieces 63, 65, 67, and 69 are instantly interchangeable. So, not only can the junction pieces 13, 15, 17, and 19 and junction pieces 63, 65, 67, and 69 and the decorative molding 21, 23, 25, and 27 be changed, either can be changed separately to create mix and match combinations.

Figure 7:
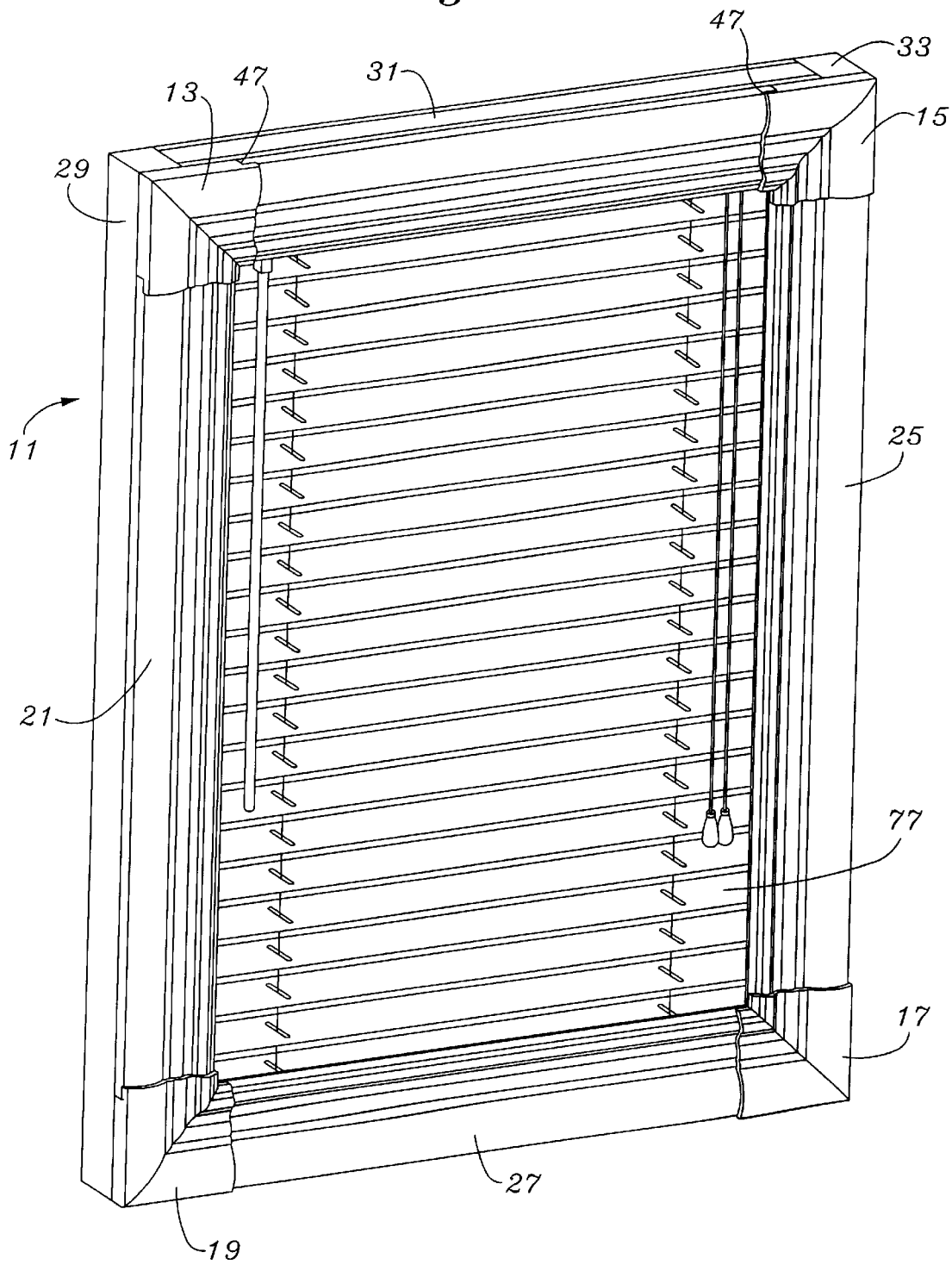
FIG. 7 is an assembled version of the window frame molding system as seen in FIG. 1 in an assembled position and with respect to a horizontal blind mounted within it, but un-attached to any window opening or wall surrounding a window opening.

Referring to FIG. 7, an assembled version of the window frame molding system 11 of FIG. 1 is seen in an assembled position and with respect to a horizontal blind mounted within it, but un-attached to any window opening or wall surrounding a window opening. Window frame molding system 11 is shown with respect to a horizontal blind set 77 mounted behind the system 11, but with no other details of attachment for the blinds which would typically be attached to a ceiling or rear window surface. Further, to show the possibilities, in this case the vertical straight mounting pieces 29 and 33 extend the full vertical length while the top mounting piece 31 and bottom mounting piece 35 (not seen in FIG. 7) abut the vertical straight mounting pieces 29 and 33. This illustrates that the straight mounting pieces 29, 31, 33, and 35 can have any orientation at the corners especially since the brackets 51 are strong and provide adequate holding.

Also as can be seen in FIG. 7 the outer peripheral surfaces of the straight mounting pieces 29, 31, 33, 35 could be applied to a peripherally inwardly set of wall surfaces just within a window opening wall space. The surfaces of both the straight mounting pieces 29, and 31 seen would directly abut the inwardly directed wall surfaces.

Conversely, the rear surfaces of straight mounting pieces 29, 31, 33, & 35 could be applied to the facing wall structure surrounding a window opening. In this case, the surfaces of both the straight mounting pieces 29 and 31, for example. Would extend out from the wall and still be seen as would the side edges of the junction pieces 13, 15, 17, and 19 and the side edges of the decorative molding 21, 23, 25, and 27 would be viewable. In this case the user may provide other covering material for aesthetic purposes. However, regardless of the mounting, it can readily be seen that any top, side and bottom gap which would exist between the horizontal blind set 77 and adjacent wall surface is eliminated. The closer the horizontal blind 77 is mounted to the system 11, the better job system 11 can do in shutting out unwanted peripheral light.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. A window frame molding system comprising:

a plurality of lengths of mounting material for mounting adjacent a window covering opening;

a plurality of decorative moldings having fasteners for interfitting with said plurality of lengths of mounting material for mounting adjacent a window covering opening; each said decorative molding slidably secured to a locked position by at least one associated said length of mounting material; and a junction member fittable associated with ends of said plurality of lengths of mounting material to restrict a slidably de-securing of at least one of said slidably secured plurality of decorative moldings.

2. The window frame molding system recited in claim 1 wherein said plurality of lengths of mounting material for mounting adjacent a window covering include a first side for engagement against at least one of an inside or an outside a window covering opening, and a second side for engaging said fasteners of said decorative moldings.

3. The window frame molding system recited in claim 2 wherein said first side is opposite said second side.

4. The window frame molding system recited in claim 2 wherein said first side is adjacent said second side.

5. The window frame molding system recited in claim 1 wherein said junction member includes a lip which overlies an adjacent one of the plurality of decorative moldings.

6. A window frame molding system comprising:

a plurality of lengths of mounting material for mounting adjacent a window covering opening;

a plurality of decorative moldings having fasteners for interfitting with said plurality of lengths of mounting material for mounting adjacent a window covering opening; each said decorative molding slidably secured to a locked position by at least one associated said length of mounting material; and a junction member associated with ends of said plurality of lengths of mounting material to restrict a slidably de-securing of at least one of said slidably secured plurality of decorative moldings; and wherein said plurality of decorative moldings have a decorative pattern and wherein said lip has an underside surface matching said decorative pattern of said decorative moldings.

7. The window frame molding system recited in claim 1 wherein said plurality of decorative moldings each have at least one fastener having a head and wherein each of said plurality of lengths of mounting material include a keyhole plate surrounding a depression for accepting said head into said depression for providing slidable locking of said fastener.

8. A window frame molding system comprising:

a plurality of lengths of mounting material for mounting adjacent a window covering opening;

a plurality of decorative moldings having fasteners for interfitting with said plurality of lengths of mounting material for mounting adjacent a window covering opening; each said decorative molding slidably secured to a locked position by at least one associated said length of mounting material; and a junction member associated with ends of said plurality of lengths of mounting material to restrict a slidably de-securing of at least one of said slidably secured plurality of decorative moldings; and wherein said plurality of lengths of mounting material each support at least one projection and wherein said junction member includes at least one blind bore within which said at least one projection is fittable to enable at least one of said junction members to prevent at least one said decorative molding from becoming slidably unsecured from its associated said length of mounting material.

9. The window frame molding system recited in claim 8 wherein said least one projection is a deformable polymeric projection.

10. The window frame molding system recited in claim 8 and further comprising a bracket interfitting between said mounting material and said decorative moldings and wherein said least one projection is carried by said bracket.

11. The window frame molding system recited in claim 8 wherein said plurality of lengths of mounting material each support at least two projections and wherein said junction member includes at least two blind bores and wherein said junction member is further position located by securing a pair of said at least two projections overlying at least two different lengths of mounting material.

* * * * *